United States Patent [19]

Neitz et al.

[11] Patent Number: 4,981,119

[45] Date of Patent: Jan. 1, 1991

[54] METHOD OF INCREASING THE EXHAUST BRAKING POWER OF AN INTERNAL COMBUSTION ENGINE

[75] Inventors: Alfred Neitz, Wendelstein; Joachim Weiss, Oberasbach, both of Fed. Rep. of Germany

[73] Assignee: MAN Nutzfahrzeuge Aktiengesellschaft, München, Fed. Rep. of Germany

[21] Appl. No.: 463,425

[22] Filed: Jan. 11, 1990

[30] Foreign Application Priority Data

Jan. 12, 1989 [DE] Fed. Rep. of Germany ..... 3900739

[51] Int. Cl.[5] ..... F02D 13/04; F02D 9/06

[52] U.S. Cl. ..... 123/321; 123/323

[58] Field of Search ..... 123/321, 323, 320, 182, 123/198 DC

[56] References Cited

U.S. PATENT DOCUMENTS

| | | | |
|---|---|---|---|
| 4,378,765 | 4/1983 | Abermath et al. | 123/321 |
| 4,423,712 | 1/1984 | Mayne et al. | 123/321 |
| 4,455,977 | 6/1984 | Kuczcnoski | 123/198 DC |
| 4,485,780 | 12/1984 | Price et al. | 123/321 |
| 4,510,900 | 4/1985 | Quenneville | 123/321 |
| 4,572,114 | 2/1986 | Sickler | 123/321 |
| 4,592,319 | 6/1986 | Meistrick | 123/321 |
| 4,706,625 | 11/1987 | Meistrick et al. | 123/321 |
| 4,741,307 | 5/1988 | Mencely | 123/321 |
| 4,836,162 | 6/1989 | Maldo-Tuczai et al. | 123/321 |
| 4,932,372 | 6/1990 | Menosky | 123/182 |

*Primary Examiner*—Raymond A. Nelli

*Attorney, Agent, or Firm*—Robert W. Becker & Associates

[57] ABSTRACT

A method of increasing the exhaust braking power of a four-stroke, reciprocating piston internal combustion engine, whereby in the braking operation, in a first and third stroke air is drawn in via an intake valve, and in a second and fourth stroke the air is compressed and, by partially opening an exhaust valve, is discharged against a damper that is disposed in an exhaust pipe or manifold. In order to increase the final compression pressure, i.e. to increase the energy that is to be applied for the compression, the exhaust valve is briefly opened at both the beginning and the end of the compression stroke.

2 Claims, 1 Drawing Sheet

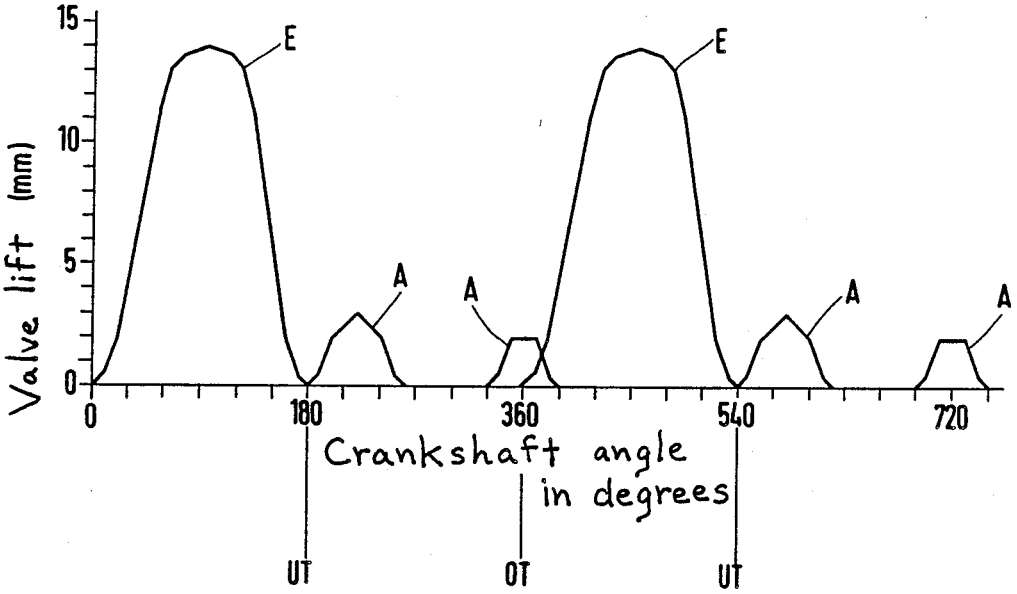
15
10
5
0
Valve lift (mm)
E
E
A
A
A
A
0
180
360
540
720
Crankshaft angle
in degrees
UT
OT
UT

METHOD OF INCREASING THE EXHAUST BRAKING POWER OF AN INTERNAL COMBUSTION ENGINE

BACKGROUND OF THE INVENTION

The present invention relates to a method of increasing the engine or exhaust braking power of a four-stroke, reciprocating piston internal combustion engine, whereby in the braking operation, in a first and third stroke air is drawn in via an intake valve, and in a second and fourth stroke the air is compressed and, by partially opening an exhaust valve, is discharged against a butterfly valve-type damper that is disposed in the exhaust pipe or manifold.

It is known to provide a damper in the exhaust manifold for the engine or exhaust braking. Such an exhaust brake operates like an air pump that works against the closed exhaust manifold. It is also known during braking operation to control the gas-changing valves in a two-cycle manner, i.e. the air that is drawn in the first and third strokes is compressed by the piston in the second and fourth strokes. As a result, a greater braking action is achieved than is possible where compression is effected during only one piston stroke.

It also known to keep the exhaust valve open slightly during the compression stroke. However, opening of the exhaust valve can only be effected in or shortly prior to the top dead center position of the piston. In so doing, the final compression pressure is of particular significance.

It is an object of the present invention to increase the final compression pressure, i.e. to increase the energy that is to be applied for the compression.

BRIEF DESCRIPTION OF THE DRAWING

This object, and other objects and advantages of the present invention, will appear more clearly from the following specification in conjunction with the accompanying drawing, which is a graph showing the opening times of the gas-changing valves during the braking operation (two-cycle operation).

SUMMARY OF THE INVENTION

The method of the present invention is characterized primarily by briefly opening the exhaust valve at both the beginning and the end of the compression stroke.

By briefly opening the exhaust valve after the bottom dead center position (at the end of the respective intake process), precompressed air flows into the cylinder from the exhaust manifold. Thus, during the respective compression stroke, a precompressed quantity of air is already provided for the compression, for which purpose the engine requires a greater amount of energy, which corresponds to a greater braking operation.

Further specific features of the present invention will be described in detail subsequently.

DESCRIPTION OF PREFERRED EMBODIMENTS

Referring now to the drawing in detail, the crank angle degrees are shown on the abscissa of the graph, and the respective valve lifts of the intake and exhaust valves are shown on the ordinate.

The respective intake valve E respectively opens between the top dead center position OT and the bottom dead center position UT of the piston (i.e. over 180° crank angle).

At the end of the intake stroke (first stroke), the pressure in the cylinder is slightly below ambient pressure. As soon as the intake valve E is closed in the bottom dead center position, the exhaust valve A is opened, as a result of which the cylinder rapidly fills with air from the exhaust manifold since at this moment the pressure differential between the exhaust manifold and the cylinder prevails. This pressure differential is great enough, even with a slight lift and short opening time of the exhaust valve (from UT to about 80° crank angle after UT), to ensure an intensive pressure increase in the cylinder.

The pressure in the exhaust manifold is maintained by an air brake or deflector. It is necessary to provide the air deflector with holes so that the pressure in the exhaust manifold does not increase excessively. Due to the pressure equalization with the cylinder when the exhaust valve is opened in the bottom dead center position, the pressure in the manifold drops slightly. However, the "pressure reservoir" exhaust manifold is again replenished at the conclusion of the following compression stroke when the compressed air flows out of the cylinder into the manifold. The final compression pressure is in the present case much greater than with heretofore known methods (Jacobs brakes) because the air is already at a higher pressure at the beginning of the compression stroke than the pressure that can be achieved via a load change that is limited to the intake of the air. In conformity therewith, the energy that has to be applied for the compression is also considerably greater.

In the following intake stroke (third stroke), the energy that is recuperated from the air that remains in the cylinder and is still under pressure should be reduced to a minimum. In addition, the pressure in the exhaust manifold should be maintained if possible. For this purpose, as the intake valve E is opened, the exhaust valve A is either simultaneously closed or is closed with a certain overlap (in the graph, the exhaust valve A is opened approximately 30° prior to OT until 30° crank angle after OT). This to a large extent prevents a back flow out of the exhaust manifold into the intake port, while the cylinder can be emptied in an unimpeded manner. The cylinder pressure rapidly drops to ambient pressure; after a short period of time, the exhaust process changes over into an intake of fresh air, thereby starting the cycle over again.

With the inventive method (tests were undertaken at an engine speed of 2200 rpm and an air deflector hole cross-sectional area of 4 cm), a braking power of approximately 300 kW at an average exhaust gas counterpressure of 3.3 bar (absolute) was achieved.

It is also conceivable to use the inventive process while maintaining the four-stroke operation.

The present invention is, of course, in no way restricted to the specific disclosure of the specification and drawing, but also encompasses any modifications within the scope of the appended claims.

WHAT WE CLAIM IS:

1. In a method of increasing the exhaust braking power of a four-stroke, reciprocating piston internal combustion engine, whereby in the braking operation, in a first and third stroke air is drawn in via an intake valve, and in a second and fourth stroke the air is compressed and, by partially opening an exhaust valve, is discharged against a butterfly valve-type damper that is disposed in an exhaust pipe or manifold, the improvement comprising the step of:

briefly opening said exhaust valve at both the beginning and the end of the compression stroke.

2. A method according to claim 1, in which said briefly opening step comprises opening said exhaust valve at the beginning of said compression stroke from the timepoint of the bottom dead center position to about 80° crank angle after said bottom dead center position, and opening said exhaust valve at the end of said compression stroke approximately 30° crank angle prior to the top dead center position to 30° after said top dead center position.

* * * * *